US010781589B2

(12) United States Patent
Cavanaugh et al.

(10) Patent No.: US 10,781,589 B2
(45) Date of Patent: Sep. 22, 2020

(54) MONOLITHIC CEILING SYSTEM

(71) Applicant: ARMSTRONG WORLD INDUSTRIES, INC., Lancaster, PA (US)

(72) Inventors: Jason T. Cavanaugh, Lancaster, PA (US); Lori Jo L. Shearer, Millersville, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 16/248,887

(22) Filed: Jan. 16, 2019

(65) Prior Publication Data

US 2019/0218776 A1 Jul. 18, 2019

Related U.S. Application Data

(60) Provisional application No. 62/617,663, filed on Jan. 16, 2018.

(51) Int. Cl.

| | |
|---|---|
| ***E04B 9/04*** | (2006.01) |
| ***B26D 1/01*** | (2006.01) |
| ***E04B 9/24*** | (2006.01) |
| ***E04B 9/28*** | (2006.01) |
| ***B26B 29/06*** | (2006.01) |
| ***E04B 9/06*** | (2006.01) |

(52) U.S. Cl.

CPC ..... *E04B 9/0435* (2013.01); *B26B 29/06* (2013.01); *B26D 1/015* (2013.01); *E04B 9/045* (2013.01); *E04B 9/24* (2013.01); *E04B 9/241* (2013.01); *E04B 9/28* (2013.01); *E04B 9/067* (2013.01)

(58) Field of Classification Search

CPC ..... E04B 9/0435; E04B 9/24; E04B 9/244; E04B 9/28; B26D 1/015

See application file for complete search history.

(56) References Cited

U.S. PATENT DOCUMENTS 3,708,935 A * 1/1973 Kossuth ..... E04B 2/7457 52/416

3,919,443 A 11/1975 Porter (Continued)

FOREIGN PATENT DOCUMENTS

FR 2982289 B1 * 2/2017 ..... E04C 2/043

WO WO 98/17881 4/1998

OTHER PUBLICATIONS

International Search Report from related PCT/US2019/013735, dated May 8, 2019.

*Primary Examiner* — Christine T Cajilig

(74) *Attorney, Agent, or Firm* — Craig M. Sterner

(57) ABSTRACT

Described herein is a method for forming a monolithic surface in a ceiling system, the method comprising overlapping a first facing sheet and a second facing sheet to create an overlap region, each of the first and second facing sheets having a first major surface opposite a second major surface and side surface extending between the first and second major surfaces, wherein the lower surface of the first facing sheet contacts the upper surface of the second facing sheet within the overlap region, and running a blade of a cutting tool along the overlap region such that the blade extends through the first and second facing sheets at a cutting angle that is oblique to the first major surface of the first facing sheet within the overlap region.

15 Claims, 10 Drawing Sheets

(56) References Cited

U.S. PATENT DOCUMENTS

| | | | | |
|---|---|---|---|---|
| 4,241,555 | A | 12/1980 | Dickens et al. | |
| 4,284,447 | A | 8/1981 | Dickens et al. | |
| 4,586,308 | A | 5/1986 | Jennings | |
| 4,907,383 | A * | 3/1990 | Winter, IV | E04C 2/288 52/309.9 |
| 5,001,879 | A | 3/1991 | Paliwoda | |
| 5,085,022 | A | 2/1992 | Paliwoda | |
| 5,236,757 | A | 8/1993 | Probst et al. | |
| 5,349,796 | A | 9/1994 | Meyerson | |
| 9,556,613 | B1 | 1/2017 | Gaydos et al. | |
| 2003/0021938 | A1 * | 1/2003 | Kraft | B29C 65/54 428/58 |
| 2006/0096213 | A1 | 5/2006 | Griffin et al. | |
| 2007/0044407 | A1 | 5/2007 | Elliott | |
| 2007/0125042 | A1 | 6/2007 | Hughes et al. | |
| 2009/0004459 | A1 | 1/2009 | Kipp et al. | |
| 2009/0173030 | A1 | 7/2009 | Gulbrandsen et al. | |
| 2011/0179740 | A1 | 7/2011 | Padmanabhan | |
| 2014/0000979 | A1 | 1/2014 | Dugan et al. | |
| 2016/0138265 | A1 * | 5/2016 | Gaydos | E04B 9/045 52/506.07 |
| 2016/0273217 | A1 | 9/2016 | Huntzinger et al. | |
| 2017/0342710 | A1 | 11/2017 | Gaydos et al. | |

* cited by examiner

MONOLITHIC CEILING SYSTEM

CROSS-REFERENCE TO RELATED APPLICATIONS

This application claims the benefit of U.S. Provisional Application No. 62/617,663, filed on Jan. 16, 2018. The disclosure of the above application is incorporated herein by reference.

BACKGROUND

Numerous types of suspended ceiling systems and methods for mounting ceiling panels have been used. One type of system includes a suspended support grid including an array of intersecting grid support members configured to hang a plurality of individual ceiling panels therefrom. It is desirable in some cases to conceal the support grid for providing the appearance of a monolithic ceiling.

SUMMARY

Described herein is a method for forming a monolithic surface in a ceiling system, the method comprising: a) providing a first facing sheet and a second facing sheet, each of the first and second facing sheets having an upper surface opposite a lower surface and a side surface extending between the upper and lower surfaces, wherein the first facing sheet comprises a first portion, a second portion, and a third portion; b) overlapping the first facing sheet and the second facing sheet such that the lower surface of the first portion of the first facing sheet faces the upper surface of the second facing sheet, the lower surface of the third portion of the first facing sheet is substantially coplanar with the lower surface of the second facing sheet, and the second portion of the first facing sheet extends oblique to the first and third portions of the first facing sheet; c) running a blade of a cutting tool through the first portion of the first facing sheet such that the blade extends through the first and second facing sheets at a cutting angle that is oblique to the first facing sheet and the second facing sheet.

Other embodiments of the present invention include, a method for forming a monolithic surface in a ceiling system, the method comprising: a) overlapping a first facing sheet and a second facing sheet to create an overlap region, each of the first and second facing sheets having a first major surface opposite a second major surface and side surface extending between the first and second major surfaces, wherein the lower surface of the first facing sheet contacts the upper surface of the second facing sheet within the overlap region; b) running a blade of a cutting tool along the overlap region such that the blade extends through the first and second facing sheets at a cutting angle that is oblique to the first major surface of the first facing sheet within the overlap region.

In other embodiments, the present invention includes a ceiling system comprising a first panel assembly comprising a first facing sheet coupled to a first body; a second panel assembly comprising a second facing sheet coupled to a second body; wherein the first and second facing sheets comprising a first major surface opposite a second major surface and a side surface extending between the first and second major surface, wherein the side surface of the first facing sheet faces the side surface of the second facing sheet, and wherein each of the first and second side surfaces extend at an oblique angle relative to lower surface of the lower surface of each respective first and second facing sheet.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplary embodiments of the present invention will be described with reference to the following drawings, where like elements are labeled similarly, and in which.

Figure 1:
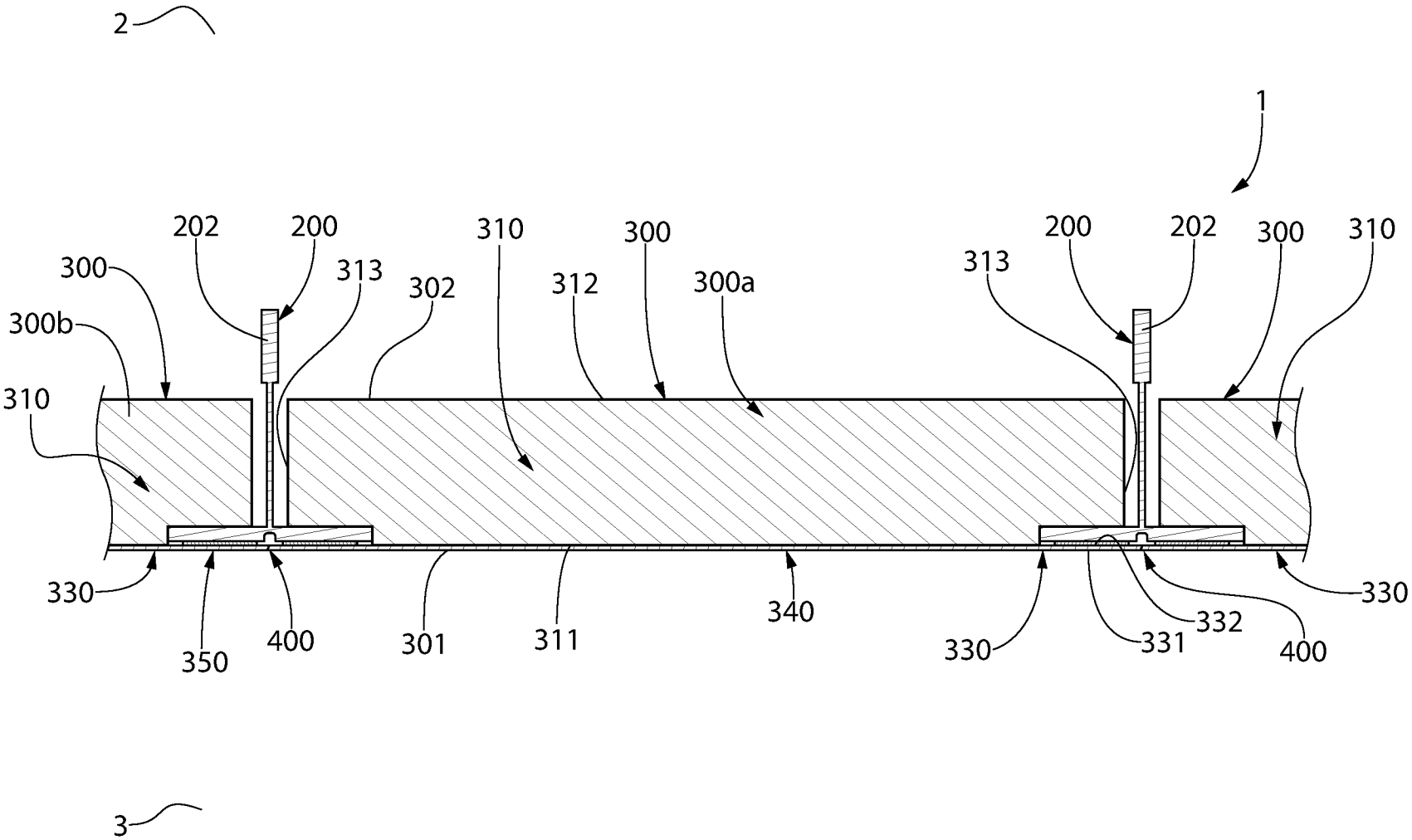
FIG. 1 is a side elevation cross-sectional view of a ceiling system comprising grid support members and ceiling panels.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

FIG. 1 depicts an exemplary embodiment of a building system 1 according to the present disclosure. The building system 1 may comprise an overhead support grid 200 including a plurality of overhead longitudinal grid support members 202 and building panels 300 supported by the grid support members 202. Although not limited to ceiling systems, in certain embodiments, the building system 1 of the present invention may be a ceiling system 1. In such embodiments the building panels 300 may be referred to as a ceiling panel 300. In other embodiments, the building system 1 of the present invention may be directed to non-ceiling applications, such as wall systems as well as other interior surfaces formed within an interior environment of a building. As such, the phrases "ceiling system" and "ceiling panel" are not limited just to ceiling applications.

The grid support members 202 are mountable in a suspended manner from an overhead building support structure. The grid support members 202 are elongated in shape having a length greater than their width (e.g. at least twice), and in various embodiments lengths substantially greater than their widths (e.g. 3 times or more). The grid support members 202 may form "runners" or "rails" and are laterally spaced apart and oriented parallel to each other as shown in FIG. 1 to position a building panel 300 therebetween. In some embodiments, the longitudinal grid support members 202 may be maintained in a substantially parallel spaced apart relationship to each other by lateral grid support members (not shown) attached between adjacent (but spaced apart) grid support members 202 at appropriate intervals using any suitable permanent or detachable manner of coupling.

In one embodiment, grid support members 202 may be horizontally oriented when installed. It will be appreciated, however, that other suitable mounted orientations of grid support members 202 such as angled or sloped (i.e. between 0 and 90 degrees to horizontal) may be used. Accordingly, although support members 202 may be described in one exemplary orientation herein as horizontal, the invention is not limited to this orientation alone and other orientations may be used.

Figure 2:
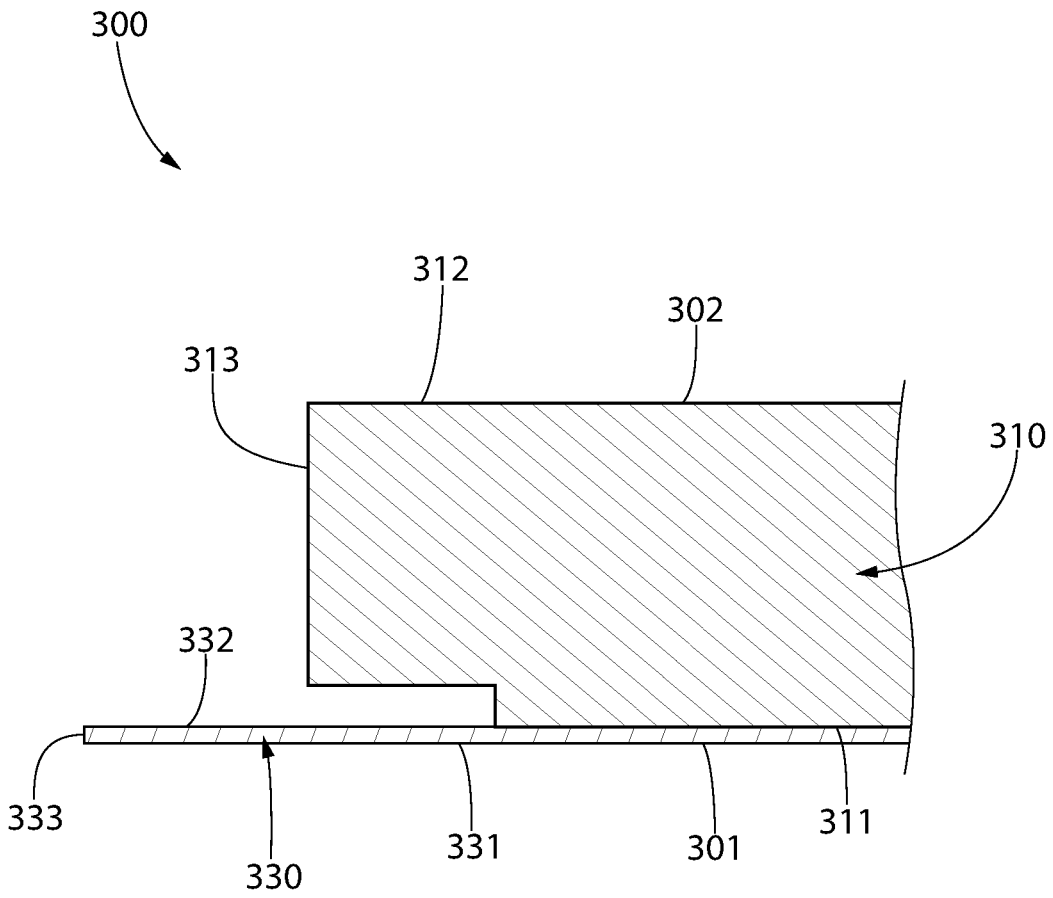
FIG. 2 is an enlarged side elevation cross-sectional view of a peripheral side or end portion of the ceiling panel.

Referring now to FIGS. 1 and 2, the building panel 300 of the present invention comprises a first major surface 301 opposite a second major surface 302. The building panel 300 may comprise a substrate 310 and a facing sheet 330 (also referred to as a "facing layer"). The substrate 310 may be a body having a first major surface 311 that is opposite a second major surface 312 and a side surface 313 extending between the first and second major surfaces 311, 312. The facing sheet 330 may comprise a first major surface 331 that is opposite a second major surface 332 and a side surface 333 extending between the first and second major surfaces 331, 332.

The body may be a fibrous body, an open-celled body, or a gypsum body. The fibrous body may be formed from a fibrous material and a binder. Non-limiting examples of fibrous material include organic fibers, inorganic fibers, and mixtures thereof. A non-limiting example of organic fiber include polyester fiber. A non-limiting example of inorganic fiber include mineral wool, rock wool, slag wool, and the like, as well as mixtures thereof.

Non-limiting examples of the open-celled body include a body having an inner core comprising a honeycomb structure formed from a plurality of interconnected cell walls that define a plurality of open cells. The cell walls may be oriented perpendicular to the first and second major surfaces 301, 302 of the ceiling panels 300 and extend vertically between the first and second major surfaces 301, 302. Any suitable shape of cells may be used, including hexagon, triangular, square, circular, etc. as some non-limiting examples.

In the open-celled body, the cell walls may be formed from a cellulosic material. In a non-limiting example, the cellulosic material may be paper, such as 20-pound Kraft paper, whereby the wall thickness ranges from about 4 mils to about 15 miles, which generally provides the requisite stiffness to the core to resist sagging of the ceiling panel without unduly adding weight to the ceiling panel structure. Cellulosic cell walls may be resin-impregnated in some embodiments. In other possible embodiments, lightweight non-paper material such as fiberglass and thin aluminum metal sheet also may perform satisfactorily for cell walls and be used. Non-woven materials, such as for example without limitation non-woven glass fibers in a resin matrix, may also be used.

The substrate 310 may exhibit an NRC value ranging from about 0.45 to about 0.99—including all NRC values and sub-ranges there-between—as measured from the first major surface 311 to the second major surface 312.

In some embodiments, the facing sheet 330 may be in the form of a scrim comprised of laminated non-woven glass fibers in a resin matrix. This type construction is suitable for high end acoustical panels to impart a smooth visual appearance, durability, and dimensional stability. Other suitable scrim materials may be used for the facing sheet 330 and are available from suppliers such as Owens Corning, Lydall, Ahlstrom and Johns Manville. Such materials may include films, sheets, woven materials and open cell foamed materials are all suitable.

The facing sheet 330 may exhibit an airflow resistance ranging from about 45 mks rayls to about 8,000 mks rayls—including all airflow resistances and sub-ranges there-between.

According to the present invention, the first major surface 331 of the facing sheet 330 may also be referred to as the "upper surface" of the facing sheet 330, and the second major surface 332 of the facing sheet 330 may also be referred to as the "lower surface" of the facing sheet 330. In other embodiments of the present invention, the facing sheet 330 may be provided separately and/or without the substrate 310, as discussed further herein.

The facing sheet 330 may have a thickness as measured from the first major surface 331 to the second major surface 332. The thickness of the facing sheet may range from about 5 mils to about 500 mils—including all thicknesses and sub-ranges there-between. In some embodiments, the thickness of the facing sheet 330 may range from about 10 mils to about 50 mils—including all thicknesses and sub-ranges there-between, preferably from about 15 miles to about 30 mils. In other embodiments, the thickness $t_1$ of the facing sheet 330 may range from about 250 mils to about 500 mils—including all thicknesses and sub-ranges there-between. The first facing sheet 340 may have a substantially uniform thickness.

As discussed further herein, the ceiling system 1 of the present invention comprises a plurality of building panels 300 such that at least two facing sheets 330 are positioned adjacent to each other, whereby the first major surface 331 of the adjacent facing sheets 330 collectively form a monolithic surface. Therefore, the ceiling system 1 of the present invention may comprise an overall first major surface 301 that is a monolithic surface formed by two or more adjacent facing sheets 330 of the building panels 300.

The ceiling system 1 may be installed in an interior space, whereby the interior space comprises a plenary space 2 and an active room environment 3. The plenary space 2 may provide space for mechanical lines within a building (e.g., HVAC, plumbing, etc.). In other embodiments, the interior space may be devoid of a plenary space 3, whereby the building panels 300 of the present invention are coupled directly to a surface of the interior space. The active space 3 provides room for the building occupants during normal intended use of the building (e.g., in an office building, the active space would be occupied by offices containing computers, lamps, etc.). Therefore, the first major surface 301 of the ceiling system 1 faces the active room environment 3 and the resulting monolithic surface formed by two or more adjacent facing sheets 330 of the building panels 300 are visible from occupants of the active space 3.

Referring now to FIG. 1, the ceiling system 1 may comprise a first and second ceiling panel 300*a*, 300*b*, may be mounted to the overhead support grid 200—whereby the first ceiling panel 300*a* comprises a first facing sheet 340 and the second ceiling panel 300*b* comprises a second facing sheet 350.

Referring now to FIGS. 5-10, the ceiling system may be installed according the following methodology. The ceiling panels 300 may be supplied in an uncut state—as shown in FIG. 2—whereby each facing sheet 330 comprises an edge portion 335. The edge portion 335 of the facing sheet comprises at least a portion of the first and second major surfaces 331, 332 as well as at least one side surface 333 of the facing sheet 330.

Specifically, the first facing sheet 340 comprises an upper surface 341 (also referred to as "first major surface") that is opposite a lower surface 342 (also referred to as a second major surface) and a first side surface 343 extending between the upper and lower surfaces 341, 342 of the first facing sheet 340. The first facing sheet 340 may have a first thickness $t_1$ as measured from the first major surface 341 to the second major surface 342 of the first facing sheet 340. The first thickness $t_1$ may range from about 5 mils to about 500 mils—including all thicknesses and sub-ranges there-between. In some embodiments, the first thickness $t_1$ may range from about 10 mils to about 50 mils—including all thicknesses and sub-ranges there-between, preferably from about 15 miles to about 30 mils. In other embodiments, the first thickness $t_1$ may range from about 250 mils to about 500 mils—including all thicknesses and sub-ranges there-between. The first facing sheet 340 may have a substantially uniform thickness.

The second facing sheet 350 comprises an upper surface 351 (also referred to as "first major surface") that is opposite a lower surface 352 (also referred to as a second major surface) and a second side surface 353 extending between the upper and lower surfaces 351, 352 of the second facing sheet 350. The first facing sheet 340 may have a second thickness $t_2$ as measured from the first major surface 351 to the second major surface 352 of the second facing sheet 350. The second thickness $t_2$ may range from about 5 mils to about 500 mils—including all thicknesses and sub-ranges there-between. In some embodiments, the second thickness $t_2$ may range from about 10 mils to about 50 mils—including all thicknesses and sub-ranges there-between, preferably from about 15 miles to about 30 mils. In other embodiments, the second thickness $t_2$ may range from about 250 mils to about 500 mils—including all thicknesses and sub-ranges there-between. The second facing sheet 350 may have a substantially uniform thickness.

The first thickness $t_1$ may be substantially equal to the second thickness $t_2$. In some embodiments, the first thickness $t_1$ and the second thickness $t_2$ may not be equal.

The first facing sheet 340 may comprise a first edge portion 345 and the second facing sheet 350 comprises a second edge portion 355. The first edge portion 345 of the first facing sheet 340 comprises the first side surface 343 of the first facing sheet 340 as well as a portion of the upper and lower surface 341, 342 of the first facing sheet 340. The second edge portion 355 of the second facing sheet 350 comprises the second side surface 353 of the second facing sheet 350 as well as a portion of the upper and lower surface 351, 352 of the second facing sheet 350.

The first and second facing sheets 340, 350 are then arranged in an overlapping arrangement such that the first edge portion 345 and the second edge portion 355 are coextensive in a direction substantially orthogonal to the facing sheets 330. Stated otherwise, coextensive refers to a plane extending in a direction substantially orthogonal to the first and second major surfaces 331, 332 of the facing sheets 330 would intersect both the first and second facing sheet 340, 350.

In the overlapping arrangement, at least a portion of the lower surface 342 of the first facing sheet 340 may face the upper surface 351 of the second facing sheet 350. In the overlapping arrangement, at least a portion of the lower surface 342 of the first facing sheet 340 may contact the upper surface 351 of the second facing sheet 350.

Although not pictured, in alternative overlapping embodiments, at least a portion of the lower surface 352 of the second facing sheet 350 may face the upper surface 341 of the first facing sheet 340. In such embodiments, the overlapping arrangement, at least a portion of the lower surface 352 of the second facing sheet 350 may contact the upper surface 341 of the first facing sheet 340.

In the overlapping arrangement, the first side surface 343 of the first facing sheet 340 may extend beyond the second side surface 353 of the second facing sheet 350 in a direction substantially parallel to the first and second major surfaces 331, 332 of the facing sheets 330. In the overlapping arrangement, the overlap of the first edge portion 345 and the second edge portion 355 results in an overlap region $O_R$ that extends from the first side surface 343 of the first facing sheet 340 to the second side surface 353 of the second facing sheet 350 in a direction substantially parallel to the first and second major surfaces 331, 332 of the facing sheets 330. The overlap region $O_R$ may be about 1% to about 99% of all surface area of the first major surface of the facing sheets 330—including all percentages and sub-ranges there-between.

Figure 3:
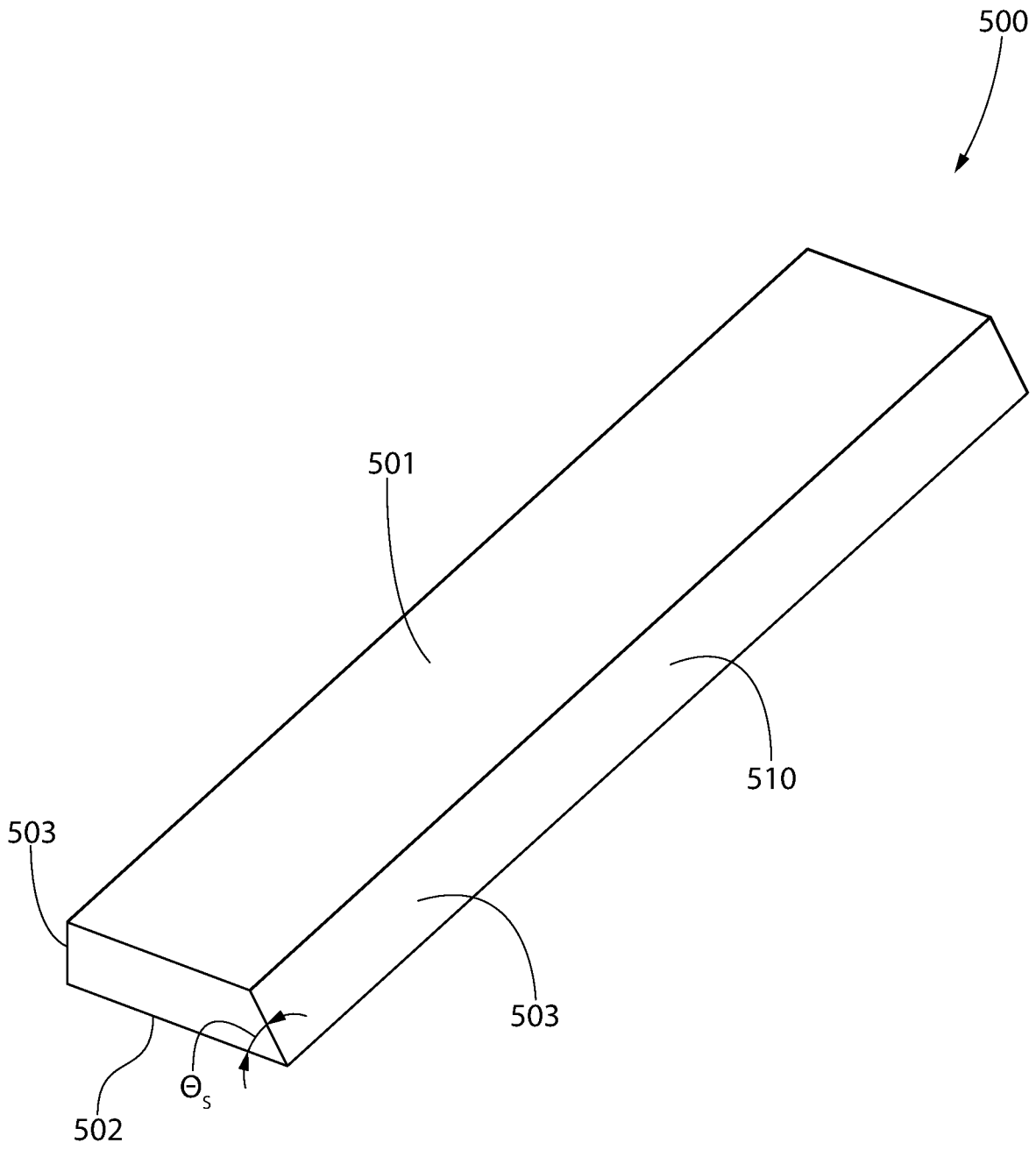
FIG. 3 is a perspective view of a cutting support according to an embodiment of the present invention.
Figure 4:
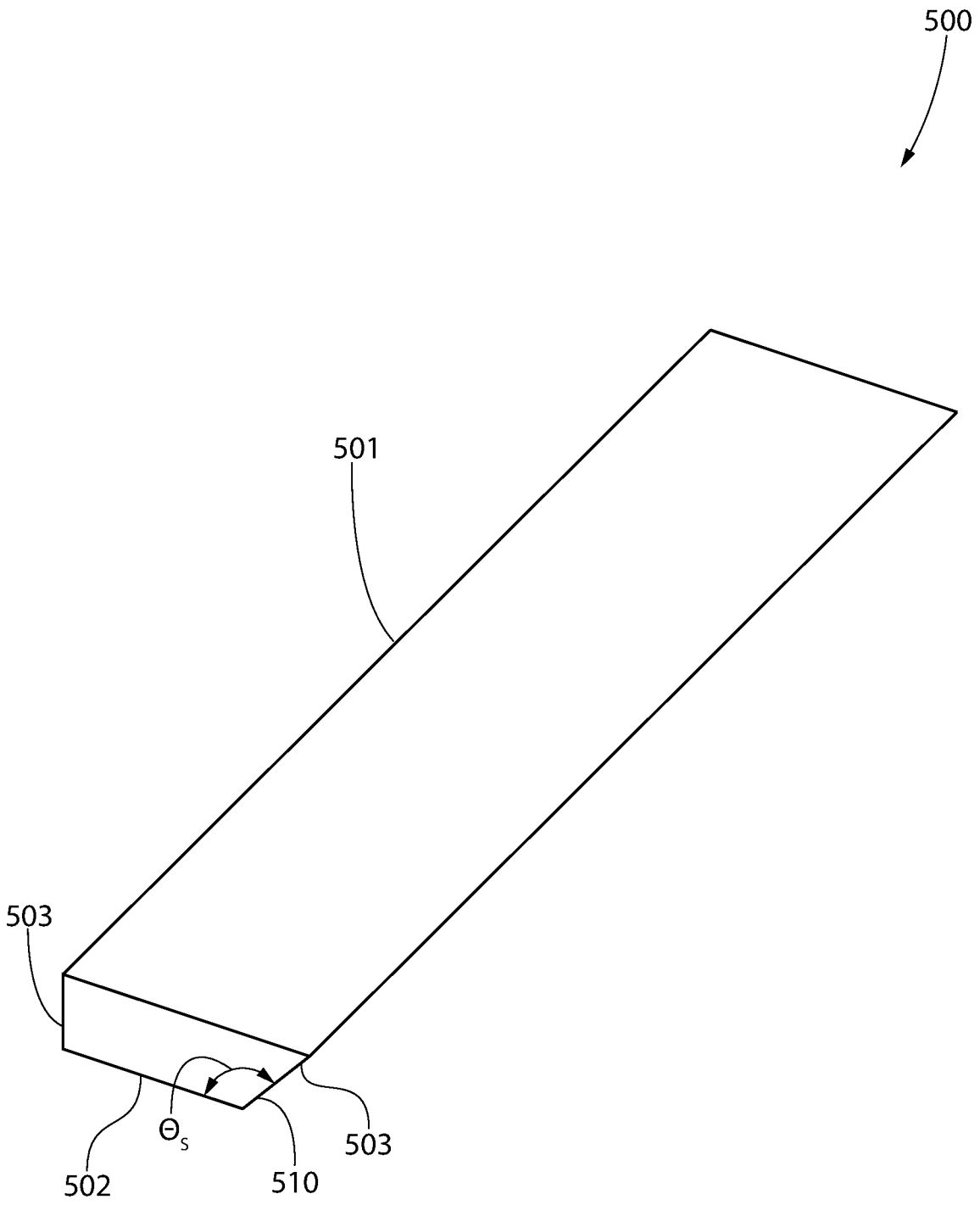
FIG. 4 is a perspective view of a cutting support according to another embodiment of the present invention.
Figure 6:
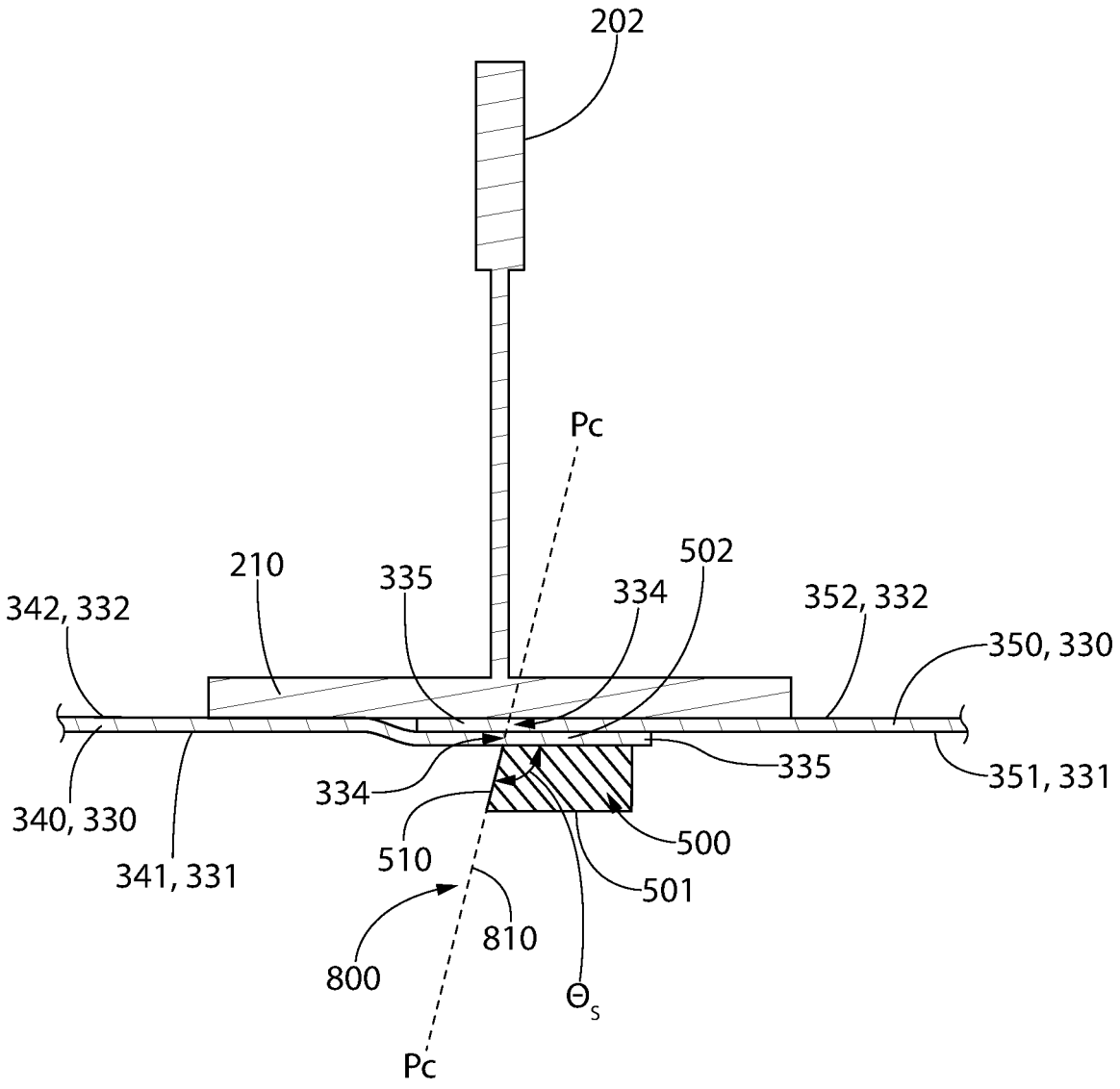

Referring now to FIGS. 3, 4, and 6, a cutting tool 800 may be used to cut into the overlap region $O_R$, whereby the cutting tool 800 cuts entirely through the first and second major surfaces 331, 332 of the facing sheets 300 to separate the edge portion 335 from each facing sheet 330 at a cut edge 334 on each facing sheet 330. The cutting tool 800 may comprise a blade 810 that extends along a cutting plane $P_C$, whereby the cutting plane is oriented at an oblique angle to the facing sheets 300—as discussed further herein. The cut edge 334 of each facing sheet 330, which is formed by the blade 810 extending between the first and second major surfaces 331, 332 of each facing sheet, is located inward of the side surface 333 of each facing sheet.

Figure 7:
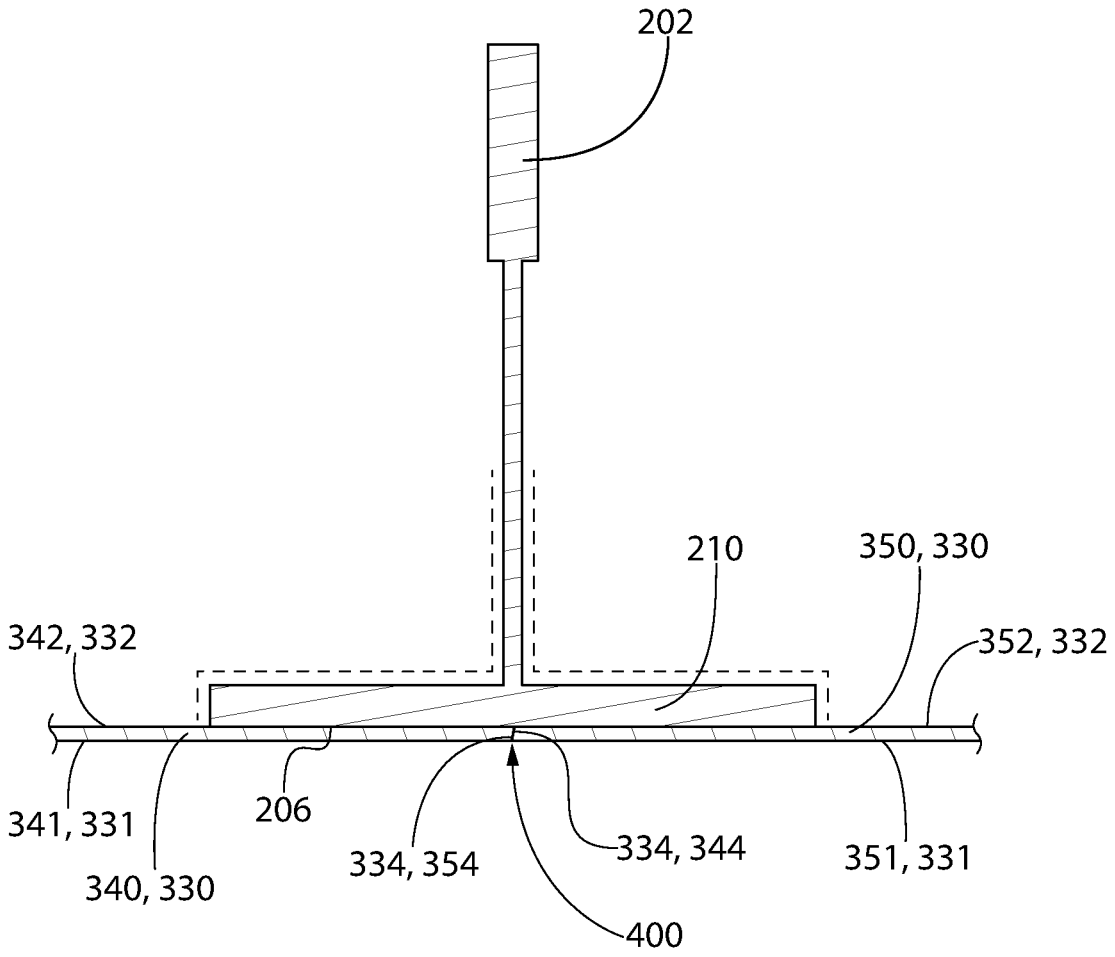

Once the cut edge 334 is formed on each facing sheet 330 and the edge portion 335 is removed from each corresponding facing sheet 300, the facing sheet is then in a cut-state—as shown in FIG. 7. With the cut edge 334 of the facing sheets 330 formed by the blade 810 of the cutting tool 800—whereby the blade 810 extends through the first and second major surfaces 331, 332 of the facing sheet 330 at an oblique angle—the resulting cut edge 334 also extends between the first and second major surfaces 331, 332 of the facing sheet 330 at an oblique angle.

Referring now to FIGS. 6 and 7, during cutting, placing the first and second facing sheets 340, 350 in the overlapping arrangement allows for a first cut edge 344 of the first facing sheet 340 and a second cut edge 354 of the second facing sheet 350 to be made by a single cut by the blade 810 through the overlapping region $O_R$. The resulting first and second cut edges 344, 354 have complimentary orientations to each other in a cut portion 400 of the resulting ceiling system 1. Specifically, the first cut edge 344 may extend downward and inward from the upper surface 341 to the lower surface 342 of the first facing sheet 344 at a first oblique angle, and the second cut edge 354 may extend downward and outward from the upper surface 351 to the lower surface 352 of the second facing sheet 354 at a second oblique angle. The first and second oblique angles may sum to be equal to about 180°. Additionally, the first and second oblique angles may result in the first and second cut edges 344, 354 are substantially parallel to each other.

In alternative embodiments, the first cut edge 344 may extend downward and outward from the upper surface 341 to the lower surface 342 of the first facing sheet 344 at a first oblique angle, and the second cut edge 354 may extend downward and inward from the upper surface 351 to the lower surface 352 of the second facing sheet 354 at a second oblique angle. The first and second oblique angles may sum to be equal to about 180°. Additionally, the first and second oblique angles may result in the first and second cut edges 344, 354 are substantially parallel to each other.

Referring now to FIGS. 3, 4, 6, as discussed, the cut portion 400 may be formed by a single cut of a blade 810 of a cutting tool 800 through the overlap region $O_R$ of a first and second facing sheet 340, 350. To ensure that the cutting plane PC of the blade 810 of the cutting tool 800 is oriented at an oblique angle, a cutting support 500 may be used.

The cutting support 500 may comprise an elongated body having an upper surface 501 that is opposite a lower surface 502 and side surfaces 502 extending between the upper and lower surfaces 501, 502. The side surfaces 503 may comprise a support surface 510 that is oriented at an oblique support angle $Ø_S$ relative to the lower surface 510 of the cutting support 500. According to some embodiments, the oblique support angle $Ø_S$ is acute (as demonstrated by FIG. 3). According to other embodiments, the oblique support angle $Ø_S$ is obtuse (as demonstrated by FIG. 4).

The cutting support 500 may be formed from any material suitable provide the necessary structural reinforcement to keep the blade 810 oriented at the desired cutting angle. Non-limiting examples of such suitable material include plastic, metal, ceramic, and the like. In some embodiments, the cutting support 500 may be formed by 3D printing a material into the desired shape of the cutting support 500. Other non-limiting examples include extruding a material into the shape of the cutting support 500 to the desired length.

During installation of the monolithic surface, the cutting support may be placed atop the overlap region OR such that the lower surface 502 faces the upper surface 331 of the topmost facing sheet 330. In a non-limiting example, the first and second facing sheets 340, 350 may be in an overlapping arrangement such that the second facing sheet 350 is positioned between a support surface 206 and the first facing sheet 340, the lower surface 502 of the cutting support 500 may contact the upper surface 341 of the first facing sheet 340—as shown in FIG. 6. In another non-limiting example, the first and second facing sheets 340, 350 may be in an overlapping arrangement such that the first facing sheet 340 is positioned between the support surface and the second facing sheet 350, the lower surface 502 of the cutting support 500 may contact the upper surface 351 of the second facing sheet 350 (not pictured).

Figure 5:
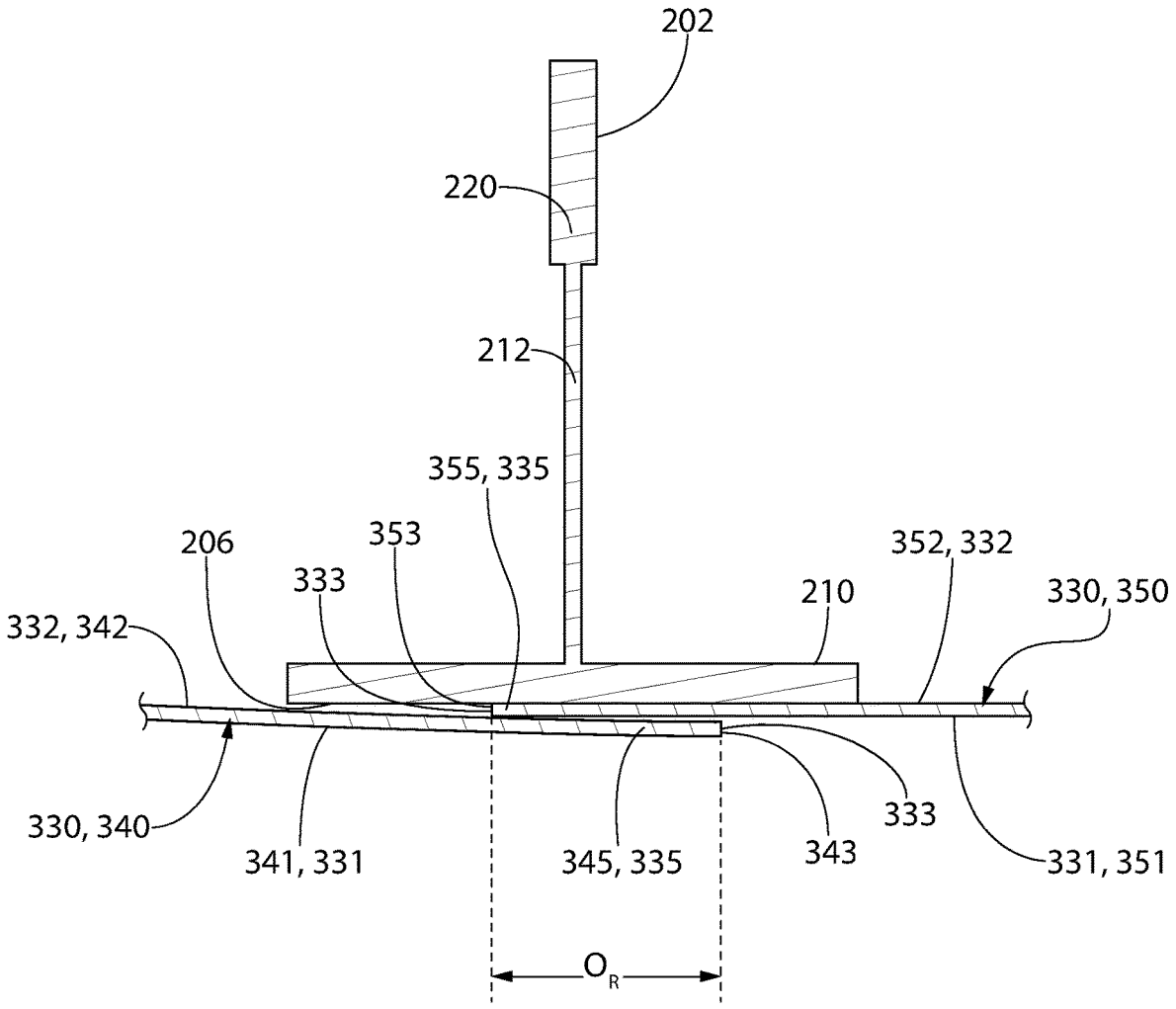
FIGS. 5-7 show front elevation cross-sectional views of a grid support member and facing sheets illustrating sequential steps in a method for installing the ceiling system of FIG. 1 to conceal the grid support member.

As demonstrated in FIGS. 5-7, in a non-limiting example, the support surface 206 may be a bottom surface of a flange 210 of a grid support member 202. Although not shown, other embodiments include the facing sheets 330 being coupled to a support surface that may include prefabricated walls, ceilings, and the like. In a non-limiting example, the support surface may be a plurality of gypsum boards having visible seems formed there-between. The facing sheets 330 may be coupled to the support surface 206 by an adhesive.

The blade 810 of the cutting tool 800 may then be inserted through and run along the overlap region $O_R$ of the first and second facing sheets 340, 350, whereby at least one major surface of the blade 810 contacts the support surface 510 of the cutting support 500. During cutting, the cutting support 500 remains substantially stationary relative to the first and second facing sheets 340, 350, thereby ensuring the resulting cutting portion 400 have a substantially consistent orientation along the length of the resulting first and second cut edges 344, 354 of the first and second facing sheets 340, 350.

Figure 8:
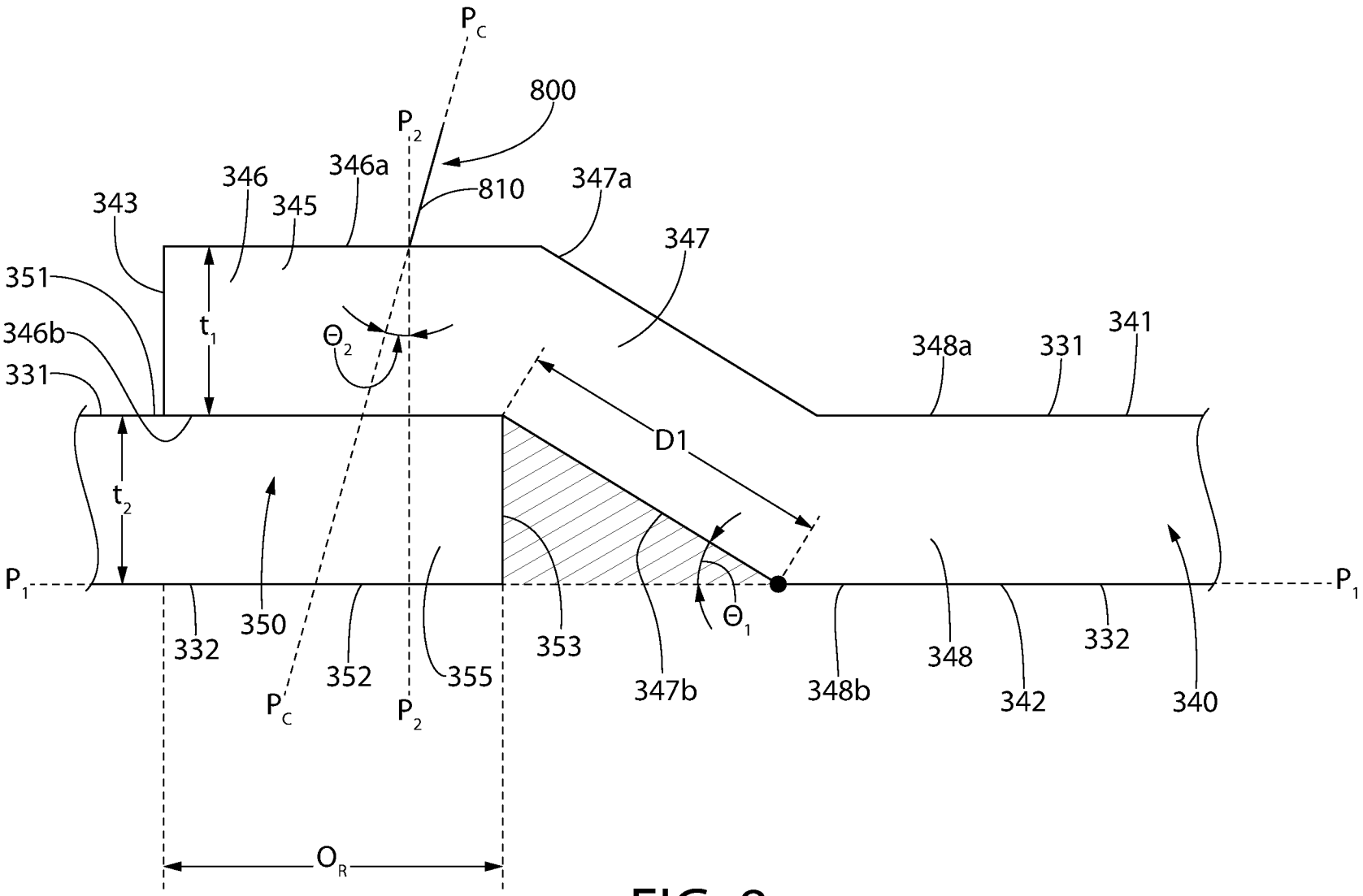
FIGS. 8-10 is a close-up side elevation view of the cutting geometry used to install the ceiling system of the present invention.
Figure 9:
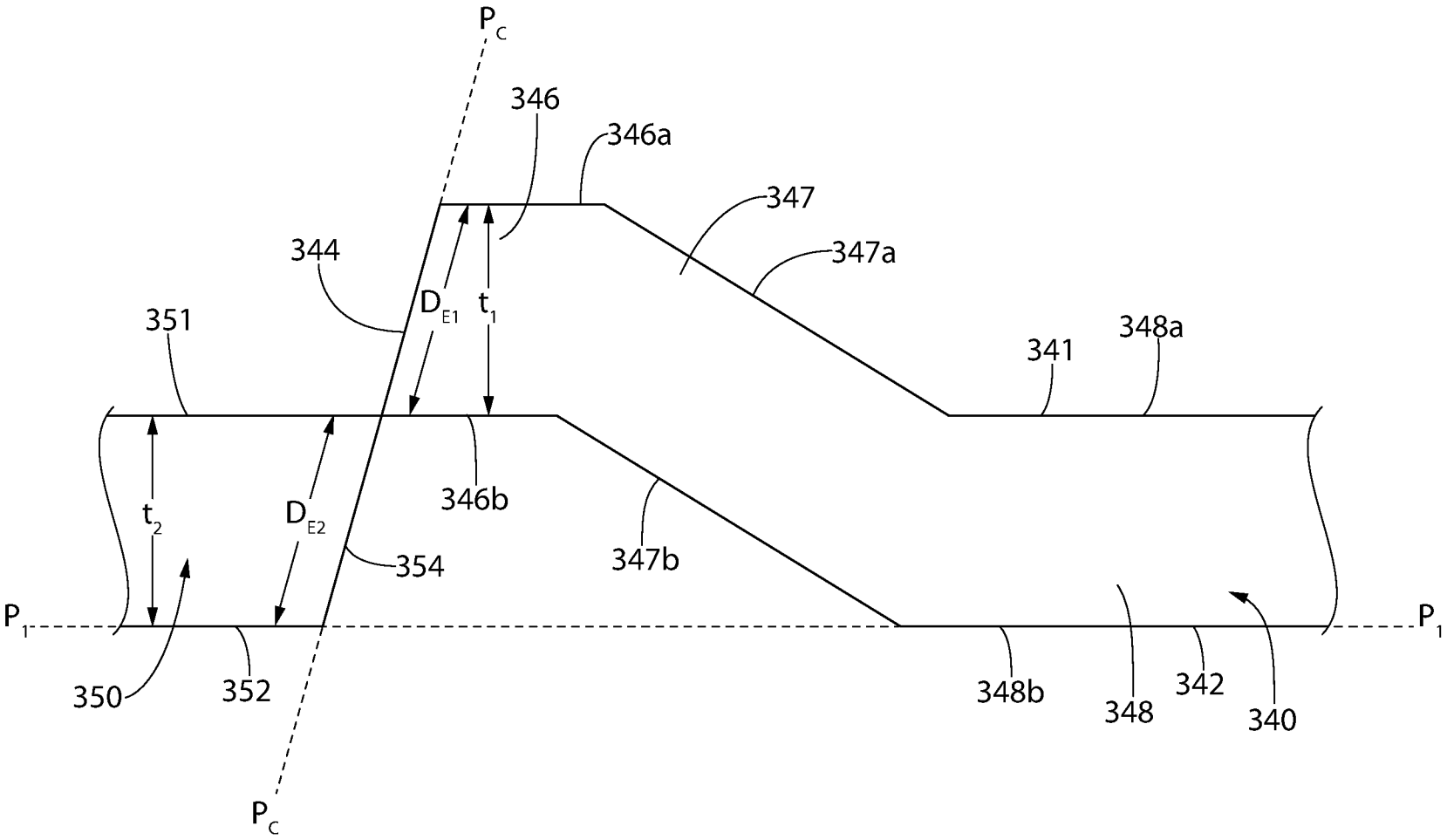
Figure 10:
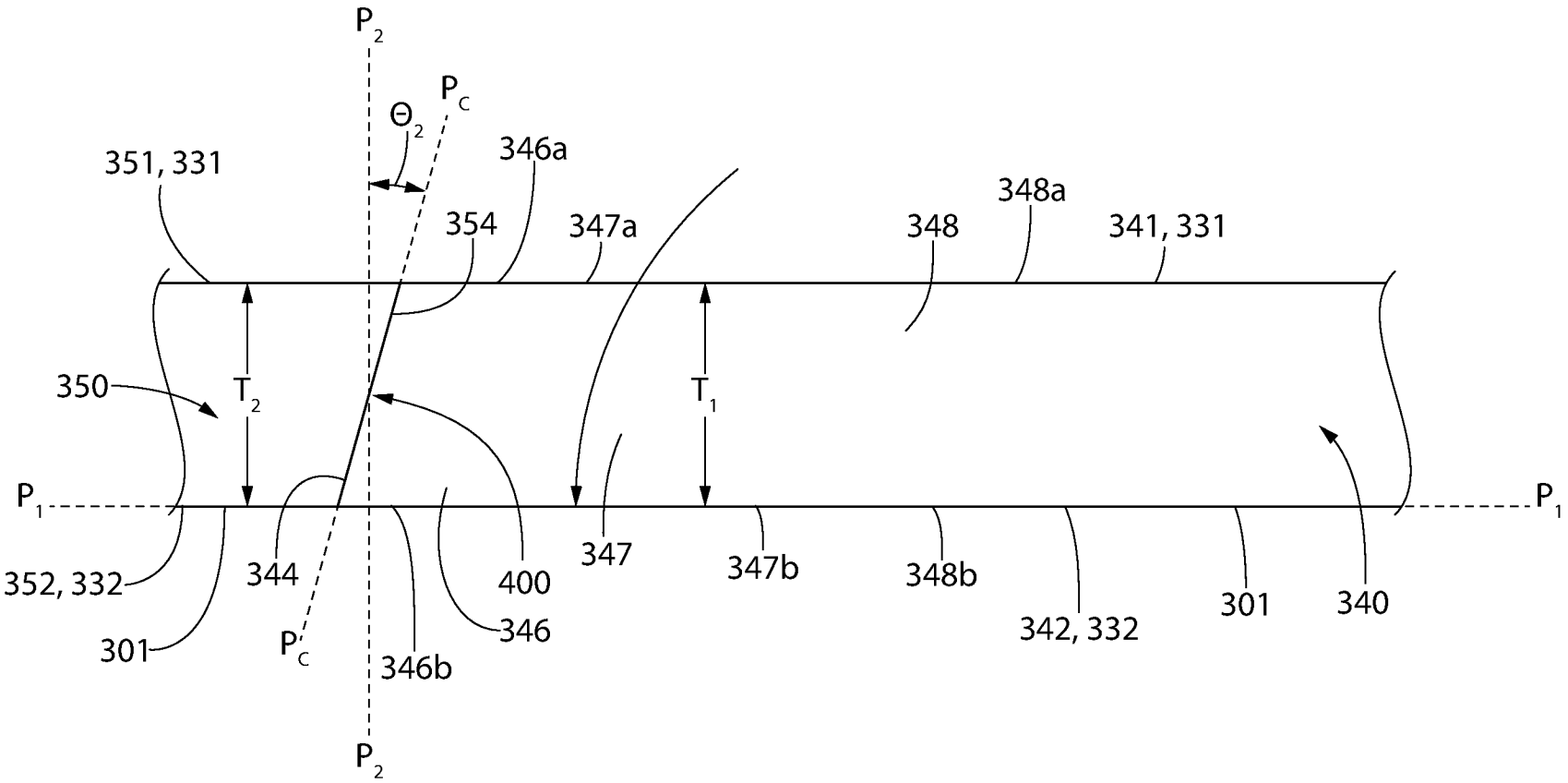

Referring now to FIGS. 8-10, the details of the cut made relative to the facing sheets 330 will be discussed in greater detail. Specifically, the overlap region $O_R$ will be formed by providing a first facing sheet 340 and a second facing sheet 350. The first facing sheet 340 comprises a first portion 346, a second portion 347, and a third portion 348. The first portion 346 is located on the perimeter of the first facing sheet 340 and comprises at least a portion of the first side surface 343. The third portion 348 is located in a central region of the first facing sheet 340 and the second portion 347 is located between the first and third portions 346, 348. The second region 347 may be circumscribed by first region 346 on the outermost boundary of the second region 347, and the second region 347 may be circumscribed by the third region 348 on the innermost boundary of the second region.

Each of the first, second and third portions 346, 347, and 348 of the first facing sheet 340 comprise at least a portion of the upper surface 341 and the lower surface 342. Thus, the portions of the upper and/or lower surface 341, 342 of the first facing sheet belong to the first portion, second portion, and third portion 346, 347, and 348 will be called out herein.

Specifically, the first portion 346 may comprise an upper surface **346*a* that is opposite a lower surface 346*b*. The upper surface 341 of the first facing sheet 340 may comprise the upper surface 346*a* of the first portion 346. The lower surface 342 of the first facing sheet 340 may comprise the lower surface 346*b* of the first portion 346. The second portion 347 may comprise an upper surface 347*a* that is opposite a lower surface 347*b*. The upper surface 341 of the first facing sheet may comprise the upper surface 347*a* of the second portion 346. The lower surface 342 of the first facing sheet 340 may comprise the lower surface 347*b* of the second portion 347. The third portion 348 may comprise an upper surface 348*a* that is opposite a lower surface 348*b*. The upper surface 341 of the first facing sheet may comprise the upper surface 348*a* of the third portion 348. The lower surface 342 of the first facing sheet 340 may comprise the lower surface 348*b* of the third portion 348. The upper surfaces 346*a*, 347*a*, 348*a* of the first, second and third portion 346, 347, 348 may be continuous. The lower surfaces 346***b*, 347*b*, 348*b* of the first, second and third portion 346, 347, 348 may be continuous.

The lower surface 347*b* of the second portion 347 may extend a distance $D_1$ that is measured from the adjacent most ends of the lower surface 346*b* of the first portion 346 and the lower surface 348*b* of the third portion 348—see FIG. 8.

In the overlapping arrangement in the un-cut state, the lower surface 346*b* of the first portion 346 of the first facing sheet 340 may face the upper surface 351 of the second facing sheet 350. The lower surface 348*b* of the third portion 348 of the first facing sheet 340 is substantially coplanar with the lower surface 352 of the second facing sheet 350. The lower surface 348*b* of the third portion 348 of the first facing sheet 340 and the lower surface 352 of the second facing sheet 350 are coplanar with a first plane $P_1$-$P_1$. A second plane $P_2$-$P_2$ exists that is oriented orthogonal to the first plane $P_1$-$P_1$, whereby the second plane $P_2$-$P_2$ intersects both the first and second facing sheets 340, 350 within the overlap region $O_R$.

In the overlapping arrangement in the un-cut state, the second portion 347 of the first facing sheet 340 may extend oblique to the first and third portions 346, 348 of the first facing sheet 340. The lower surface 347*b* of the second portion 347 may extends oblique to at least one of the lower surface 346*b*, 348*b* of the first and third portions 346, 348. The lower surface 347*b* of the second portion 347 may extend oblique to at least one of the upper surfaces 346*a*, 348*a* of the first and third portions 346, 348.

A first angle $Ø_1$ may be formed between the lower surface 347*b* of the second portion 347 of the first facing sheet 340 and the first plane $P_1$-$P_1$. The first angle $Ø_1$ is an acute angle.

During cutting, the blade 810 of the cutting tool 800 extends through the overlap region $O_R$ such that the cutting plane $P_C$-$P_C$ is oriented at a second angle $Ø_2$ relative to the second plane $P_2$-$P_2$. The second angle $Ø_2$ is an acute angle. The second angle $Ø_2$ may also be referred to as the "cutting angle."

According to the present invention, the first angle $Ø_1$ may range from about 1° to about 89°—including all angles and subranges there-between. According to the present invention, the second angle $Ø_2$ may range from about 1° to about 89°—including all angles and subranges there-between. A ratio of the first angle $Ø_1$ to the second angle $Ø_2$ may range from about 1.1:1.0 to about 4.0:1.0 including all ratios and sub-ranges there-between. The ratio of the first angle $Ø_1$ to the second angle $Ø_2$ may range from about 1.5:1.0 to about 3.0:1.0 including all ratios and sub-ranges there-between. In a preferred embodiment, the ratio of the first angle $Ø_1$ to the second angle $Ø_2$ may range from about 1.8:1.0 to about 2.2:1.0—including all ratios and sub-ranges there-between. In some embodiments, the ratio of the first angle $Ø_1$ to the second angle $Ø_2$ may be about 2:1.

The second thickness $t_2$ may be substantially equal to the following:

$$T_2=\mathrm{SIN}(Ø_1)\times D_1$$

Whereby $D_1$ is the distance of the lower surface 347*b* of the second portion 347 of the first facing sheet 340.

Referring now to FIGS. 9 and 10, after cutting the first and second edge portions 345, 355 of the first and second facing sheets 340, 350, the first and second edge portions 345, 355 are removed, thereby exposing the first cut edge 344 of the first facing sheet 340 and the second cut edge 354 of the second facing sheet 350. After removing the first and second edge portions, the first and second facing sheets are moved relative to each other such that the first and second edge portions 345, 355 are immediately opposite of each other and the first thickness $t_1$ overlaps with the second thickness $t_2$. Stated otherwise, after removing the edge portions 345, 355 of the first and second facing sheets 340, 350, and moving the first and second facing sheets 340, 350 relative to each other, the lower surface 342 of the first facing sheet 340 is substantially coplanar with the lower surface 352 of the second facing sheet 350.

In particular, the lower surface 348*b* of the third portion 348 of the first facing sheet 340 is substantially coplanar with the lower surface 352 of the second facing sheet 350 along the first plane $P_1$-$P_1$. The lower surface 347*b* of the second portion 347 of the first facing sheet 340 is substantially coplanar with the lower surface 352 of the second facing sheet 350 along the first plane $P_1$-$P_1$. Additionally, for the remains of the first portion 346 still forming part of the first facing sheet 340, the lower surface 346*b* of the first portion 346 of the first facing sheet 340 is substantially coplanar with the lower surface 352 of the second facing sheet 350 along the first plane $P_1$-$P_1$.

Additionally, the upper surface 348*a* of the third portion 348 of the first facing sheet 340 is substantially coplanar with the upper surface 351 of the second facing sheet 350 and parallel to the first plane $P_1$-$P_1$. The upper surface 347*a* of the second portion 347 of the first facing sheet 340 is substantially coplanar with the upper surface 351 of the second facing sheet 350 and parallel to the first plane $P_1$-$P_1$. Additionally, for the remains of the first portion 346 still forming part of the first facing sheet 340, the upper surface 346*a* of the first portion 346 of the first facing sheet 340 is substantially coplanar with the upper surface 351 of the second facing sheet 350 and parallel to the first plane $P_1$-$P_1$.

The first cut edge 344 has a first distance $D_{1E}$ as measured between the upper and lower surface 341, 342 of the first facing layer 340. The first distance $D_{1E}$ may be greater than the first thickness $t_1$ of the first facing layer 340. The second side surface 354 has a second distance $D_{2E}$ as measured between the upper and lower surfaces 351, 352 of the second facing layer 350. The second distance $D_{2E}$ may be greater than the second thickness $t_2$ of the second facing layer 350. The second plane P2-P2 may be located such that it intersects both the first and second side surfaces 344, 354 of the first and second facing sheet 340, 350. The second angle $Ø_2$ may also be measured between the second plane and first side surface 344 (or second side surface 354). The first thickness $t_1$ may be substantially equal to the following:

$$T_1=\mathrm{COS}(Ø_2)\times D_{1E}$$

Whereby $D_{1E}$ is the first distance of the first cut edge 344 of the first facing sheet 340. Additionally, the second thickness $t_2$ may be substantially equal to the following:

$$T_2=\mathrm{COS}(Ø_2)\times D_{2E}$$

Whereby $D_{2E}$ is the second distance of the second cut edge 354 of the second facing sheet 350. The first distance $D_{1E}$ and the second distance $D_{2E}$ may be substantially equal.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed:

1. A method for forming a monolithic surface in a ceiling system, the method comprising:

a) providing a first facing sheet and a second facing sheet, each of the first and second facing sheets having an upper surface opposite a lower surface and a side surface extending between the upper and lower surfaces, wherein the first facing sheet comprises a first portion, a second portion, and a third portion;

b) overlapping the first facing sheet and the second facing sheet such that the lower surface of the first portion of the first facing sheet faces the upper surface of the second facing sheet, the lower surface of the third portion of the first facing sheet is substantially coplanar with the lower surface of the second facing sheet, and the second portion of the first facing sheet extends oblique to the first and third portions of the first facing sheet, the lower surface of the third portion coupled to a support surface; and c) running a blade of a cutting tool through the first portion of the first facing sheet such that the blade extends through the first and second facing sheets at a cutting angle that is oblique to the first facing sheet and the second facing sheet.

2. The method according to claim 1, wherein a first angle is formed between the lower surface of the second portion of the first facing sheet and a first plane that is coextensive with the first portion of the lower surface of the first facing sheet and the lower surface of the second facing sheet, wherein the first angle is an acute angle.

3. The method according to claim 2, wherein the blade comprises a body extending along a cutting plane and the cutting angle is formed between the cutting plane and a second plane that is orthogonal to the first plane.

4. The method according to claim 3, wherein the cutting angle is acute.

5. The method according to claim 3, wherein a ratio of the first angle to the cutting angle ranges from about 1.1:1 to about 4:1.

6. The method according to claim 1, wherein the first facing sheet has a substantially uniform thickness as measured between the upper and lower surface.

7. The method according to claim 1, wherein the thickness of the second facing sheet is substantially equal to $\sin(Ø_1)\times$ D1, wherein D1 is the distance of the lower surface of the second portion extending between the lower surface of the first and third portions of the first facing sheet.

8. A method for forming a monolithic surface in a ceiling system, the method comprising:

a) overlapping a first facing sheet and a second facing sheet to create an overlap region, each of the first and second facing sheets having a first major surface opposite a second major surface and side surface extending between the first and second major surfaces, wherein a first portion of the lower surface of the first facing sheet contacts the upper surface of the second facing sheet within the overlap region and a second portion of the lower surface of the first facing sheet outside of the overlap region is coupled to a support surface; and b) running a blade of a cutting tool along the overlap region such that the blade extends through the first and second facing sheets at a cutting angle that is oblique to the first major surface of the first facing sheet within the overlap region.

9. The method according to claim 8, wherein after step b) an edge portion of the first facing sheet is removed to form a first cut edge of the first facing sheet, and an edge portion of the second facing sheet is removed to form a second cut edge of the second facing sheet, the first cut edge extending at an oblique angle to the lower surface of the first facing sheet and the second cut edge extending at an oblique angle to the lower surface of the second facing sheet.

10. The method according to claim 9, wherein the first cut edge extends downward and outward from the upper surface of the first facing sheet and the second cut edge extends downward and inward from the upper surface of the second facing sheet.

11. The method according to claim 9, wherein the first cut edge extends downward and inward from the upper surface of the first facing sheet and the second cut edge extends downward and outward from the upper surface of the second facing sheet.

12. The method according to claim 9, wherein after removing the edge portions of the first and second facing sheets, the first cut edge of the first facing sheet and the second cut edge of the second facing sheet are substantially parallel.

13. The method according to claim 9, wherein after removing the edge portions of the first and second facing sheets, the lower surface of the first facing sheet is substantially coplanar with the lower surface of the second facing sheet.

14. The method according to claim 9, wherein after removing the edge portions of the first and second facing sheets, the upper surface of the first facing sheet is substantially coplanar with the upper surface of the second facing sheet.

15. The method according to claim 8, wherein the first and second facing sheets have a substantially uniform thickness as measured between the upper and lower surface.

* * * * *